US010609971B2

(12) United States Patent
Rinne

(10) Patent No.: US 10,609,971 B2
(45) Date of Patent: Apr. 7, 2020

(54) SHIRT FOR CARRYING MOBILE DEVICES AND RELATED SYSTEMS METHODS

(71) Applicant: Jeffrey Rinne, San Diego, CA (US)

(72) Inventor: Jeffrey Rinne, San Diego, CA (US)

( * ) Notice: Subject to any disclaimer, the term of this patent is extended or adjusted under 35 U.S.C. 154(b) by 210 days.

(21) Appl. No.: 15/794,513

(22) Filed: Oct. 26, 2017

(65) Prior Publication Data

US 2018/0103703 A1 Apr. 19, 2018

Related U.S. Application Data

(63) Continuation-in-part of application No. 29/581,297, filed on Oct. 18, 2016.

(60) Provisional application No. 62/413,010, filed on Oct. 26, 2016.

(51) Int. Cl.

| | |
|---|---|
| ***A41D 27/20*** | (2006.01) |
| ***A41B 1/08*** | (2006.01) |
| ***A41D 13/00*** | (2006.01) |
| *A41D 27/10* | (2006.01) |

(52) U.S. Cl.

CPC ..... *A41D 27/205* (2013.01); *A41B 1/08* (2013.01); *A41D 13/0012* (2013.01); *A41D 27/10* (2013.01); *A41D 2300/322* (2013.01); *A41D 2300/33* (2013.01)

(58) Field of Classification Search

CPC ..... A41D 27/205; A41B 1/08
USPC ..... 2/250, 251; 381/124
See application file for complete search history.

(56) References Cited

U.S. PATENT DOCUMENTS

| | | | | |
|---|---|---|---|---|
| 3,193,842 | A | 7/1965 | Bell | |
| D218,587 | S | 9/1970 | Lawson | |
| 4,825,471 | A | 5/1989 | Jennings | |
| 5,119,979 | A | 6/1992 | Kallman | |
| 5,388,274 | A * | 2/1995 | Glover | A61F 5/028 128/100.1 |
| 5,592,953 | A | 1/1997 | Delao | |
| 5,768,706 | A * | 6/1998 | Griffith | A63B 21/065 2/102 |
| D425,584 | S | 5/2000 | Hines | |
| 6,253,379 | B1 | 6/2001 | Collier | |
| 6,260,202 | B1 * | 7/2001 | Villalobos | G21F 3/02 2/102 |
| 6,826,782 | B2 | 12/2004 | Jordan | |
| D632,059 | S | 2/2011 | Abrams | |
| D633,279 | S | 3/2011 | Turkbas | |
| 7,992,225 | B2 | 8/2011 | Demus | |
| 8,613,112 | B2 | 12/2013 | Santucci et al. | |
| 8,661,563 | B2 | 3/2014 | Evans | |
| 8,898,816 | B2 | 12/2014 | Highfield | |
| 9,144,256 | B2 | 9/2015 | Gheneva et al. | |

(Continued)

*Primary Examiner* — Timothy K Trieu
(74) *Attorney, Agent, or Firm* — Buche & Associates, P.C.; John K. Buche; Bryce A. Johnson

(57) ABSTRACT

An athletic shirt with a pocket on the sleeve configured to receive a mobile device. The sleeve also features a receiver for a strap, wherein the strap can be attached and used to wrap around the user's arm and pocket with the mobile device to securely hold and store the mobile device during exercise, such as running, walking, or weight lifting. The athletic shirt may also feature an interior pocket within the pocket on the sleeve that is configured to carry keys, cash, cards, or other personal items. The athletic shirt can also be worn in casual environments with the strap removed, so that individuals can transition seamlessly from exercising to a casual environment.

15 Claims, 8 Drawing Sheets

(56) References Cited

U.S. PATENT DOCUMENTS

| | | | | |
|---|---|---|---|---|
| 9,149,073 | B1 | 10/2015 | Hirshberg | |
| D747,039 | S | 1/2016 | Espino | |
| 9,242,093 | B1 | 1/2016 | Sherman | |
| 9,247,776 | B1 | 2/2016 | Kim | |
| 9,271,532 | B2 | 3/2016 | Cole | |
| 9,282,777 | B2 | 3/2016 | Diakite | |
| 9,427,027 | B1 | 9/2016 | Frierson et al. | |
| D775,456 | S | 1/2017 | Braccia | |
| D792,057 | S | 7/2017 | Krocheski | |
| 2001/0042263 | A1 | 11/2001 | Uchida | |
| 2001/0050991 | A1* | 12/2001 | Eves | H01Q 1/273 381/11 |
| 2005/0246823 | A1 | 11/2005 | Groom | |
| 2006/0075537 | A1 | 4/2006 | Tsai | |
| 2006/0206990 | A1 | 9/2006 | Demus | |
| 2006/0227675 | A1 | 10/2006 | Fried | |
| 2007/0245444 | A1 | 10/2007 | Brink | |
| 2007/0261703 | A1* | 11/2007 | Gheneva | A41D 27/205 131/231 |
| 2008/0184459 | A1 | 8/2008 | Barnes | |
| 2009/0000002 | A1 | 1/2009 | Hadash | |
| 2009/0211000 | A1 | 8/2009 | Roux | |
| 2012/0051571 | A1 | 3/2012 | Charvat | |
| 2012/0060261 | A1 | 3/2012 | Raviv | |
| 2012/0074184 | A1* | 3/2012 | Morgan | A45F 5/00 224/222 |
| 2012/0186000 | A1 | 7/2012 | Raviv | |
| 2013/0318674 | A1 | 12/2013 | Banks | |
| 2015/0060430 | A1 | 3/2015 | Tsuge | |
| 2015/0216240 | A1 | 8/2015 | Martel | |

* cited by examiner

SHIRT FOR CARRYING MOBILE DEVICES AND RELATED SYSTEMS METHODS

CROSS-REFERENCE TO RELATED APPLICATIONS

This application claims the priority and benefit of U.S. Provisional Application No. 62/413,010, filed Oct. 26, 2016, entitled "Shirt for Carrying Mobile Devices and Related Systems and Methods." This application is also a continuation-in-part of U.S. application Ser. No. 29/581,297, filed Oct. 18, 2016, entitled "Athletic Top." These applications are incorporated in their entirety by reference herein.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND AN INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field of athletic and casual shirts configured to receive, hold, and bind an electronic device.

Background of the Invention

Electronic mobile devices now have the ability to do a multitude of functions outside of communicating with others via voice or text, such as play music, take pictures track distance run, and track calories burned just to name a few. Accordingly, many individuals prefer carrying their electronic mobile devices when they walk, run, or exercise, so that they can take advantage of all of the benefits of their mobile device and have a method of communication readily available. Some individuals simply carry a mobile device in the pocket of pants or shorts while exercising, but in carrying this way, the mobile device can (a) fall out, (b) cause discomfort, or (c) impede an individual's performance while exercising. Others hold a mobile device via a belt accessory, hand accessory, or an armband accessory. All of these forms of carrying a mobile device can be uncomfortable, impede performance, or even look aesthetically unappealing.

Accordingly, the present invention is an athletic shirt that integrates a pocket into the sleeve of an athletic shirt that is configured to receive a mobile device while providing a means for binding or strapping the mobile device securely in place. Additionally, the athletic shirt has additional storage for keys, cash, cards, or other important personal items. Furthermore, the athletic shirt, while maintaining its ability to securely hold mobile devices, may also be easily converted into a comfortable and polished shirt that can be worn in casual settings without the mechanism that secures the device.

Some embodiments of accessories or pockets exist to carry mobile devices, such as U.S. Pat. No. 9,282,777 to Diakite, which discloses a garment with a built-in pocket and a waterproof seal to store handheld electronic devices, or U.S. Pat. No. 4,913,326 to Echelson, which discloses an armband for carrying audio devices. However, neither Diakite nor Echelson discloses an athletic shirt with an integrated pocket for receiving a mobile device, an interior pocket for personal items, and a built in hook or clasp mechanism for receiving a band that can strap the mobile device securely in place—and later be removed.

Therefore, a need exists for a minimalistic, sleek, comfortable, and aesthetically pleasing way to carry a mobile device while exercising without impeding an individual's performance while exercising or competing.

SUMMARY OF THE INVENTION

In view of the foregoing, an object of this invention is to provide an athletic shirt with an integrated pocket and band system for receiving and securing a mobile device.

Another object of this invention is to provide an athletic shirt that can hold a mobile device without the need of an armband mobile device carrying accessory, yet be aesthetically pleasing.

Another object of this invention is to provide an athletic shirt with a pocket for a mobile device and a pocket for other personal items.

Another object of this invention is to provide an athletic shirt configured to carry a mobile device that is aesthetically pleasing in casual environments.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Disclosed is an athletic shirt with at least one integrated pocket to hold a mobile device and personal items and a hook, clasp, or attachment for an armband to hold the mobile device securely in place.

Figure 1:
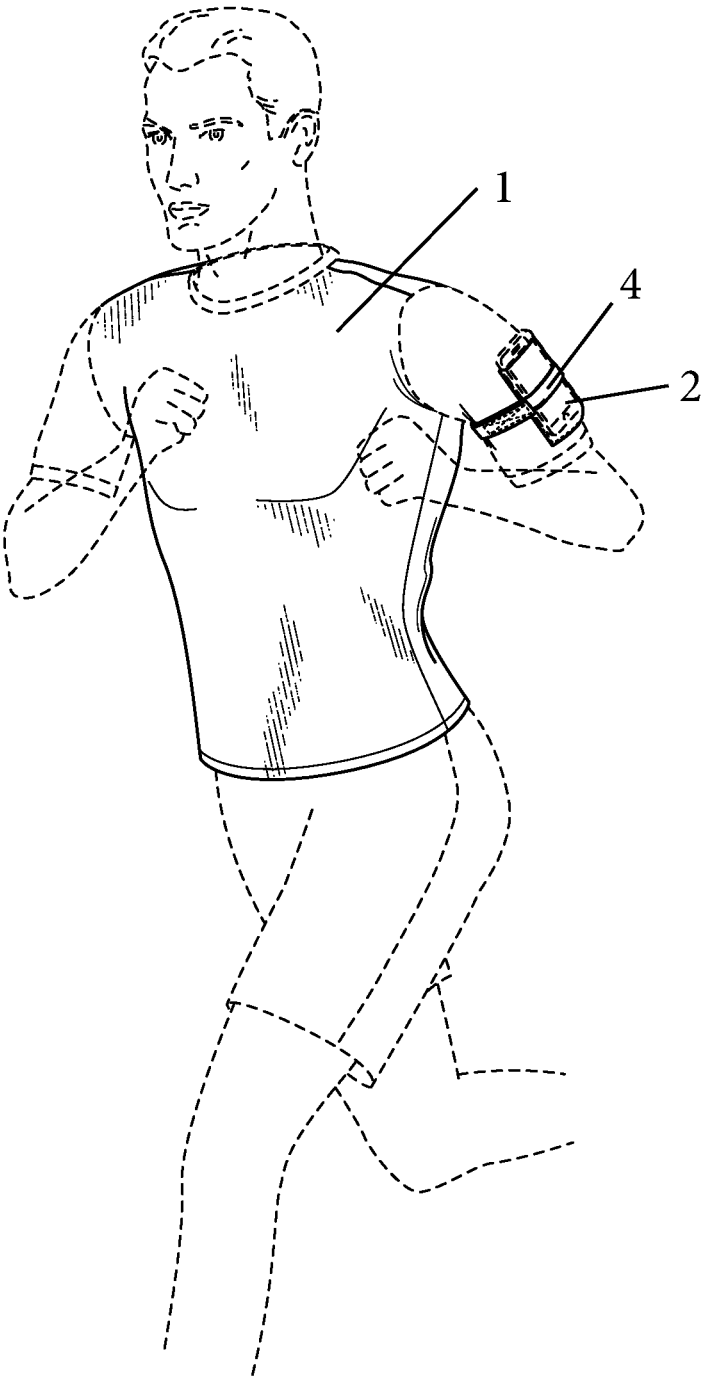
FIG. 1 is a contextual view of one embodiment of the athletic shirt holding a mobile device.

FIG. 1 is a contextual view of one embodiment of the athletic shirt holding a mobile device. Referring to FIG. 1, in one embodiment, the athletic shirt 1 is configured with at least one integrated pocket 2 and has a means for attaching an armband. The athletic shirt 1 is designed to be comfortably worn for all types of exercise, such as running, walking, or weightlifting.

Figure 2:
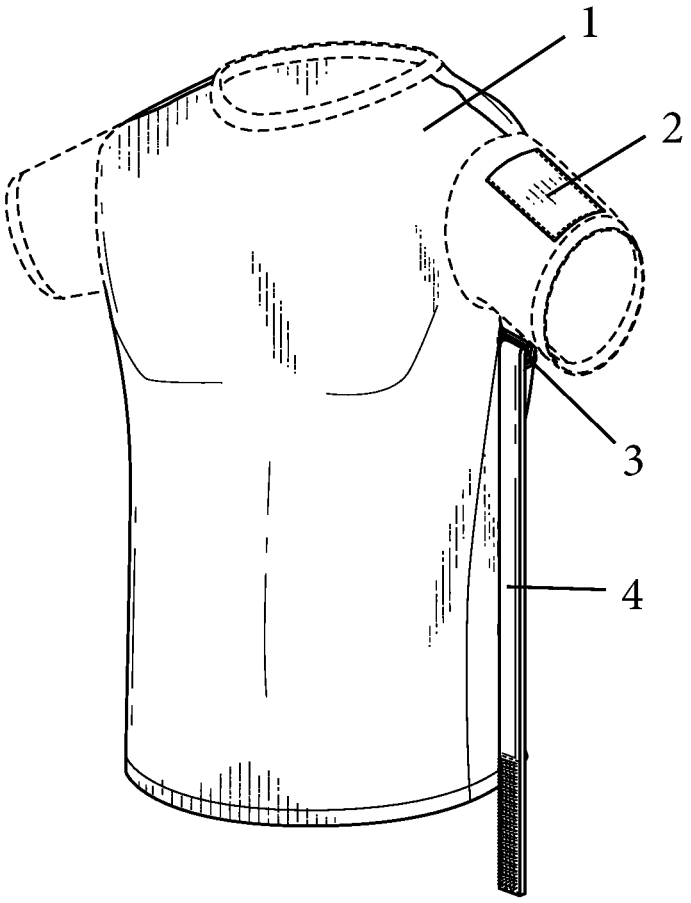
FIG. 2 is a perspective view of one embodiment of the athletic shirt.
Figure 3:
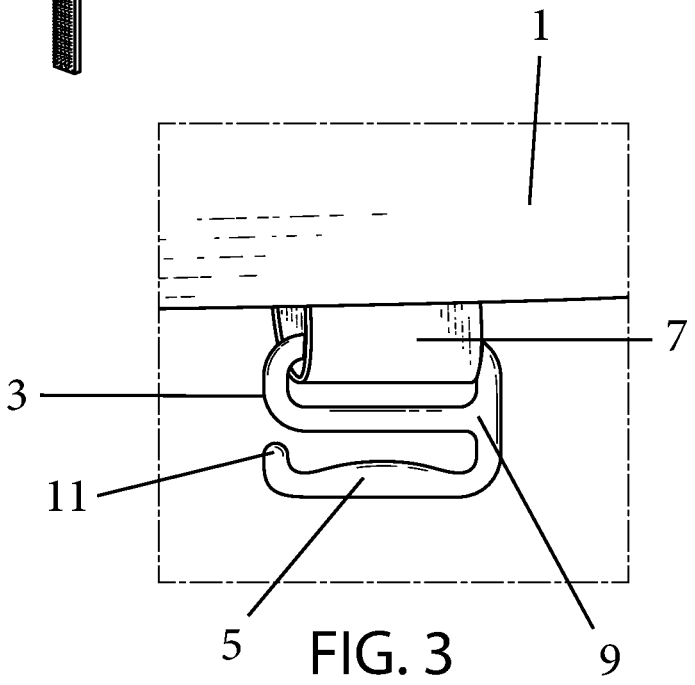
FIG. 3 is a zoomed-in view of one embodiment of a hook of the athletic shirt.

FIG. 2 is a perspective view of one embodiment of the athletic shirt 1. Referring to FIG. 2, the athletic shirt 1 may feature a receiver 3 that is configured to receive a band or strap 4. FIG. 3 is a zoomed-in view of the receiver 3. In one embodiment, the receiver 3 may be a hook or a clasp. The receiver 3 is configured to receive a closed loop of a strap 4, wherein the strap 4 can slide onto or be clipped into a receiver 3. The receiver 3 preferably features a hook 5 at its lower portion, a closed loop at its upper portion 9, which is fixed to a loop 7, and wherein said hook 5 also features an upturned catch 11 at its distal end. Furthermore, the catch 11 is facing towards the body of the athletic shirt 1, which allows the receiver 3 to use gravity as an aid in keeping the strap 4 in place and prevents it from falling off. This is the preferred orientation because if the catch 11 is facing towards the end of the sleeve of a the shirt 1, then when the user's arms are at an angle that is less than ninety degrees in relation to the ground, the strap 4 will have a higher probability of sliding off of the receiver 3.

Figure 4:
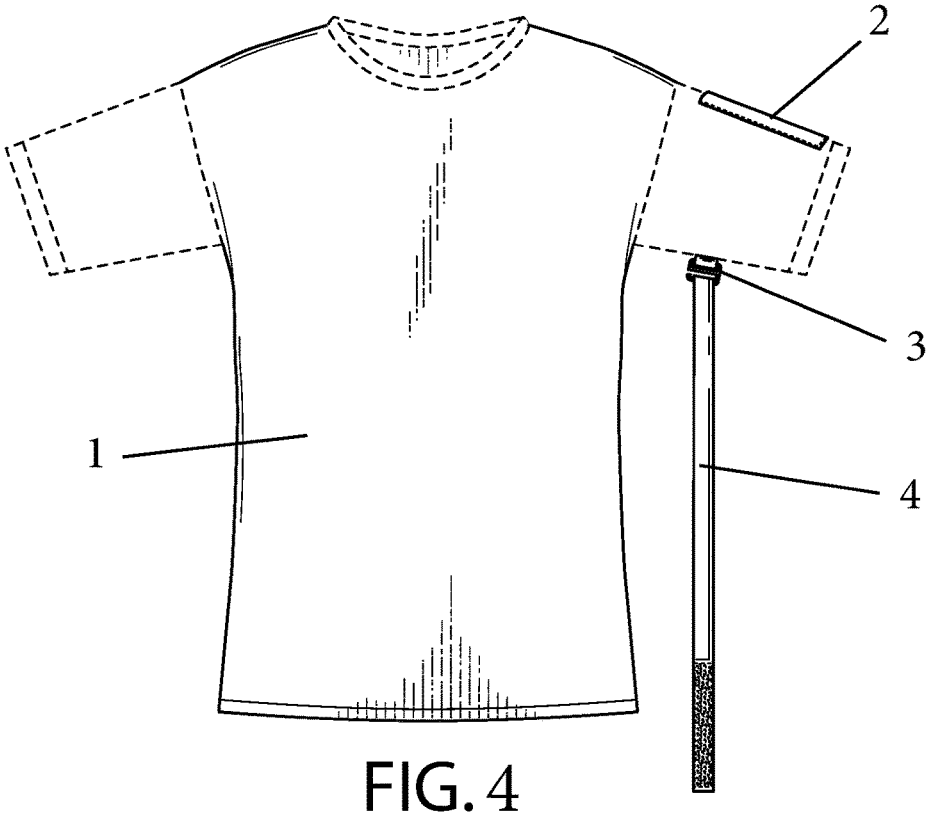
FIG. 4 is a front view of one embodiment of the athletic shirt.
Figure 5:
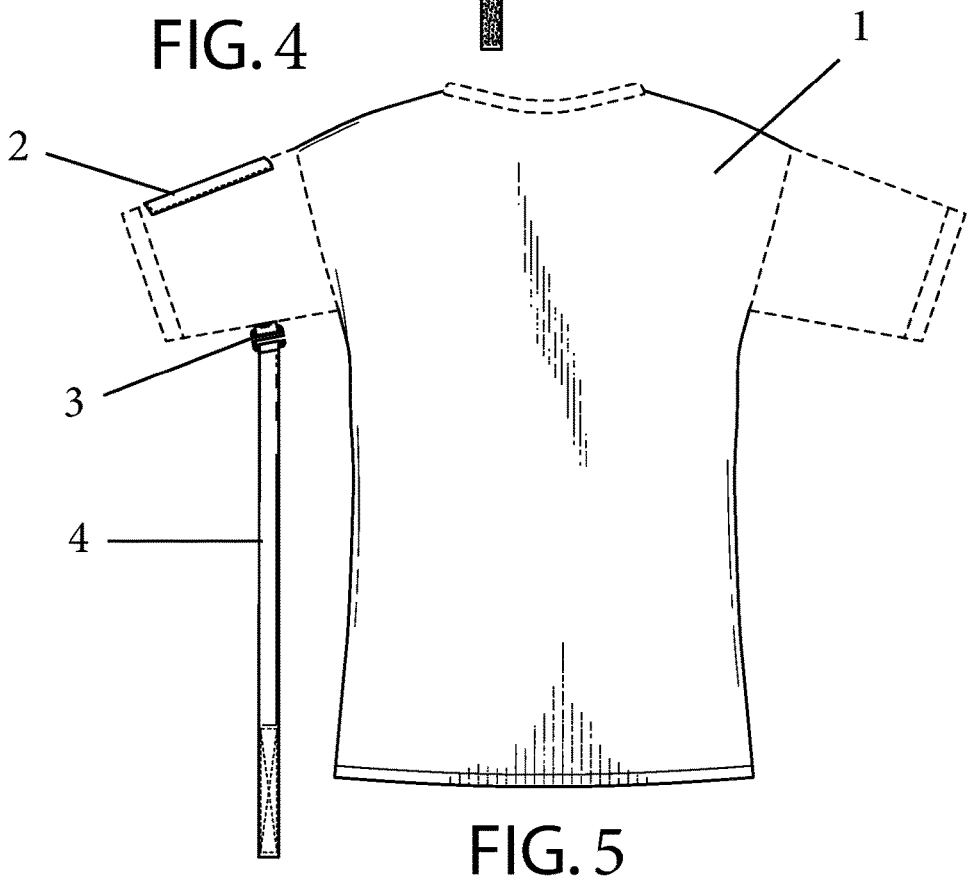
FIG. 5 is a back view of one embodiment of the athletic shirt.
Figure 6:
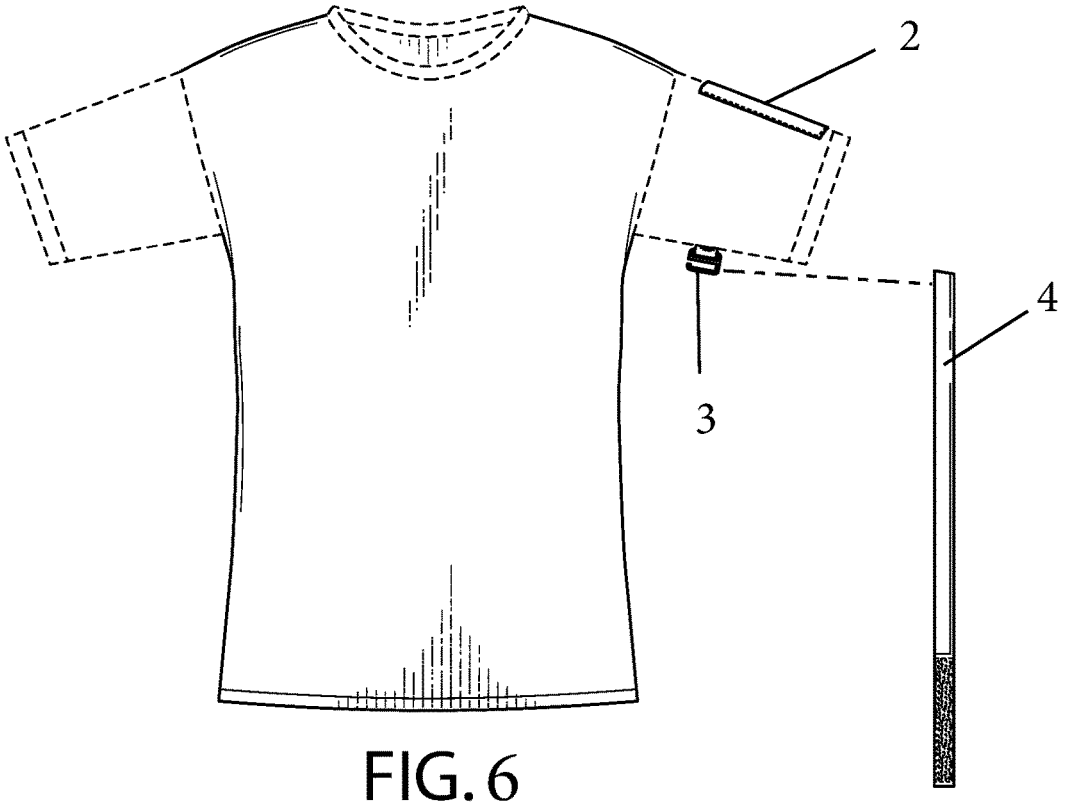
FIG. 6 is an exploded front view of one embodiment of the athletic shirt.
Figure 7:
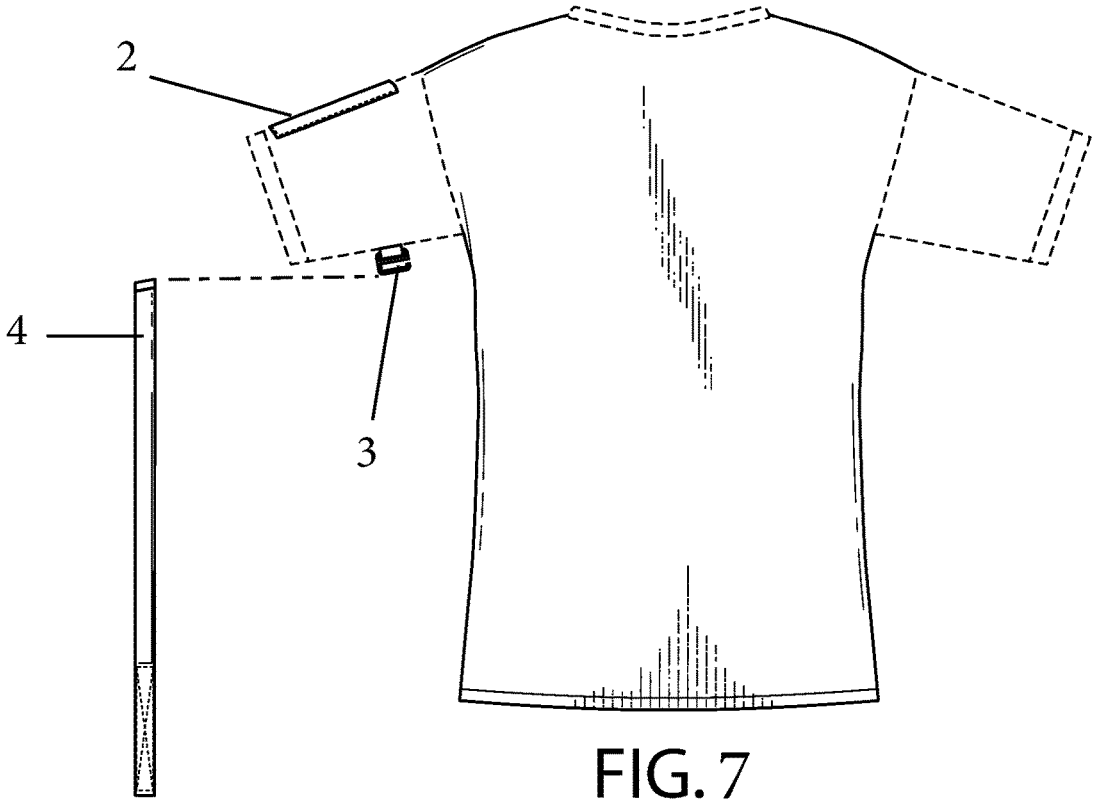
FIG. 7 is an exploded back view of one embodiment of the athletic shirt.

FIG. 4 and FIG. 5 are front and back views of one embodiment of the athletic shirt 1 respectively. FIG. 6 and FIG. 7 are exploded front and back views of one embodiment of the athletic shirt 1 that shows how a strap 4 can be attached or removed from the receiver 3. Referring to FIGS. 6 and 7, the athletic shirt 1 can look and function as a casual shirt that can be worn in casual setting, however, a user can attach a strap to the sleeve of a shirt to securely strap a mobile device into a pocket 2. In use, a user may obtain a strap 4 and attach it to the receiver 3 by looping a closed loop portion of the strap 4 around a hook of the receiver 3. The user may then wrap the strap around the arm and pocket 2 of the shirt until it is wrapped snugly around the arm and pocket 2. The user then secures the strap 4 by layering the hook and loop pile (i.e. Velcro®) ends over each other to create a secure fit. In other embodiments, the strap 4 may feature a hook and clasp attachment, a button and button-hole attachment, a zipper attachment, or other attachment means known to one of skill in the art.

Figure 8:
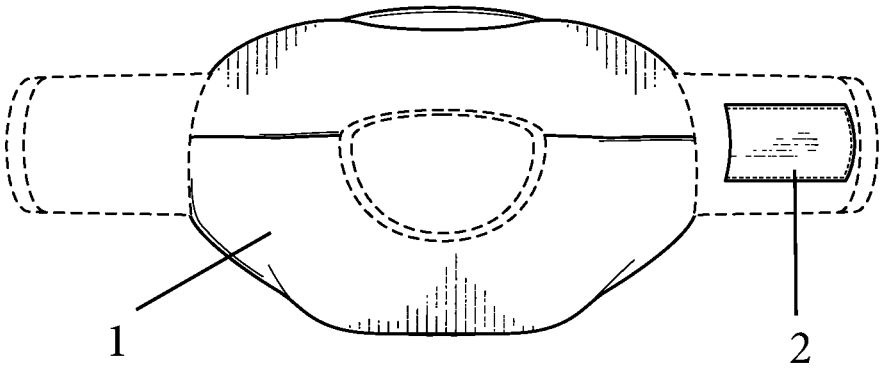
FIG. 8 is a top view of one embodiment of the athletic shirt.
Figure 9:
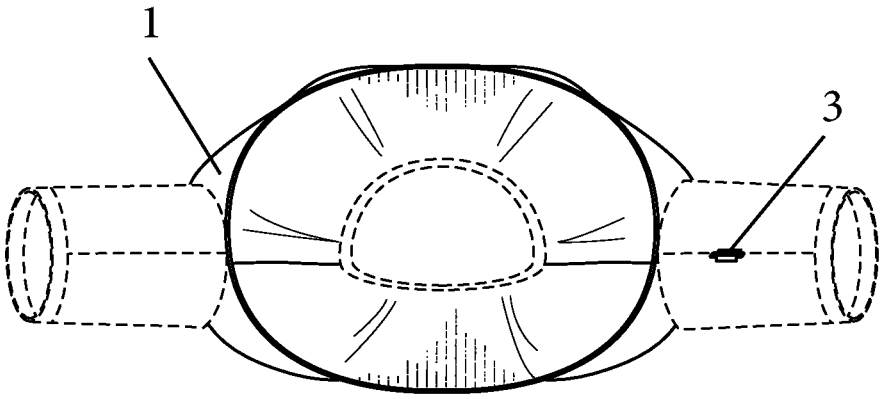
FIG. 9 is a bottom view of one embodiment of the athletic shirt.

FIG. 8 is a top view of one embodiment of the athletic shirt 1 and FIG. 9 is a bottom view of on embodiment of the athletic shirt 1. In one embodiment, the athletic shirt 1 is a crew neck collar, however, the athletic shirt 1 may also feature a v-neck collar, or a henley collar. In another embodiment, the athletic shirt 1 is a polo shirt. Furthermore, the athletic shirt 1 can be short sleeve, long sleeve, or ¾ sleeve in length. The athletic shirt 1 can be worn with the strap 4 attached or without the strap 4 attached.

Figure 10:
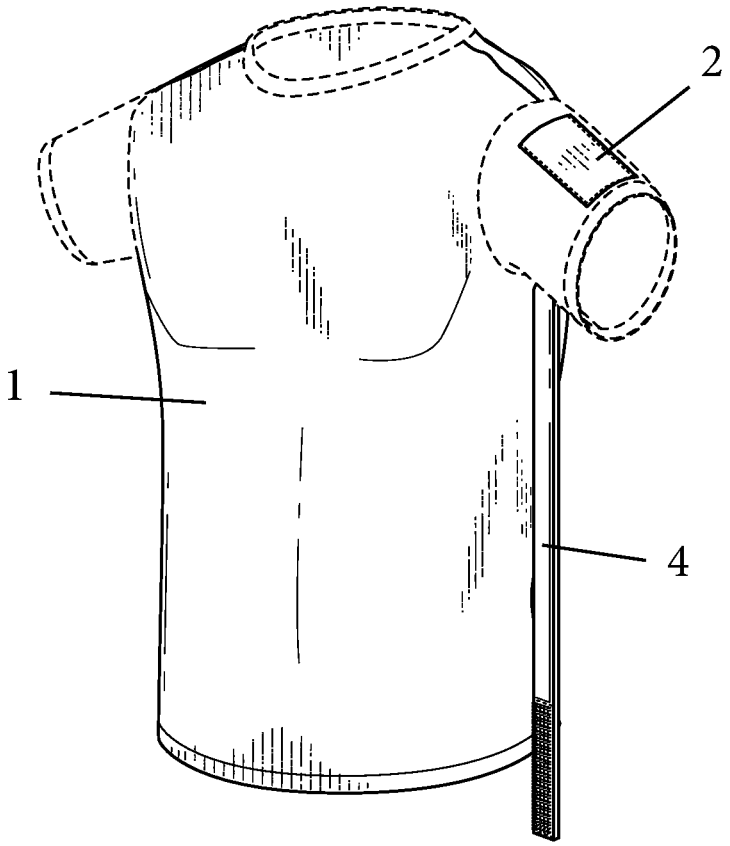
FIG. 10 is a perspective view of one embodiment of the athletic shirt.
Figure 11:
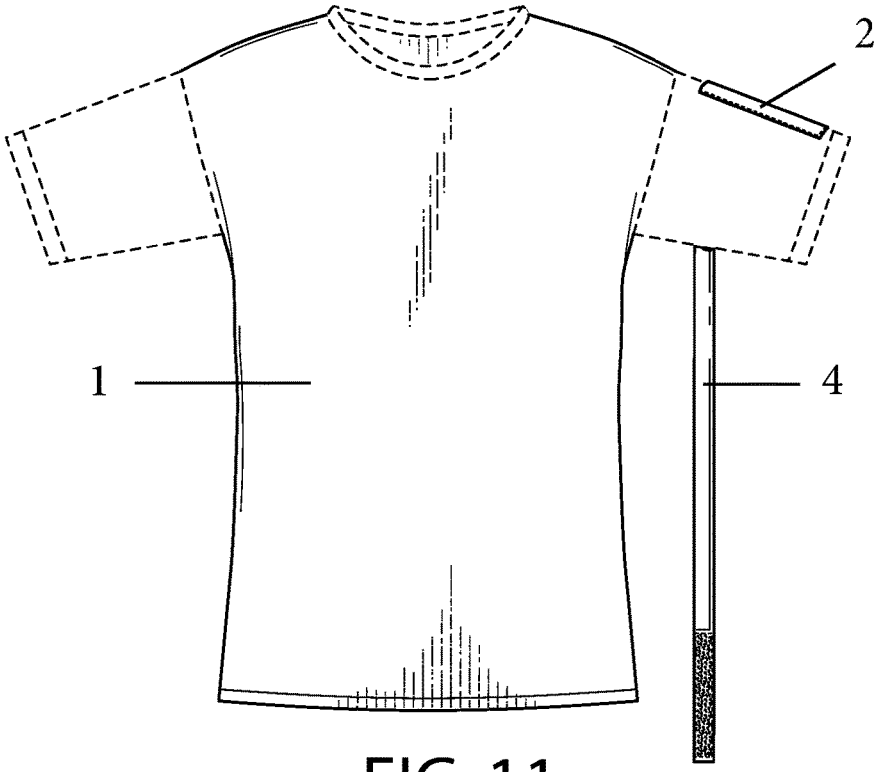
FIG. 11 is a front view of one embodiment of the athletic shirt.
Figure 12:
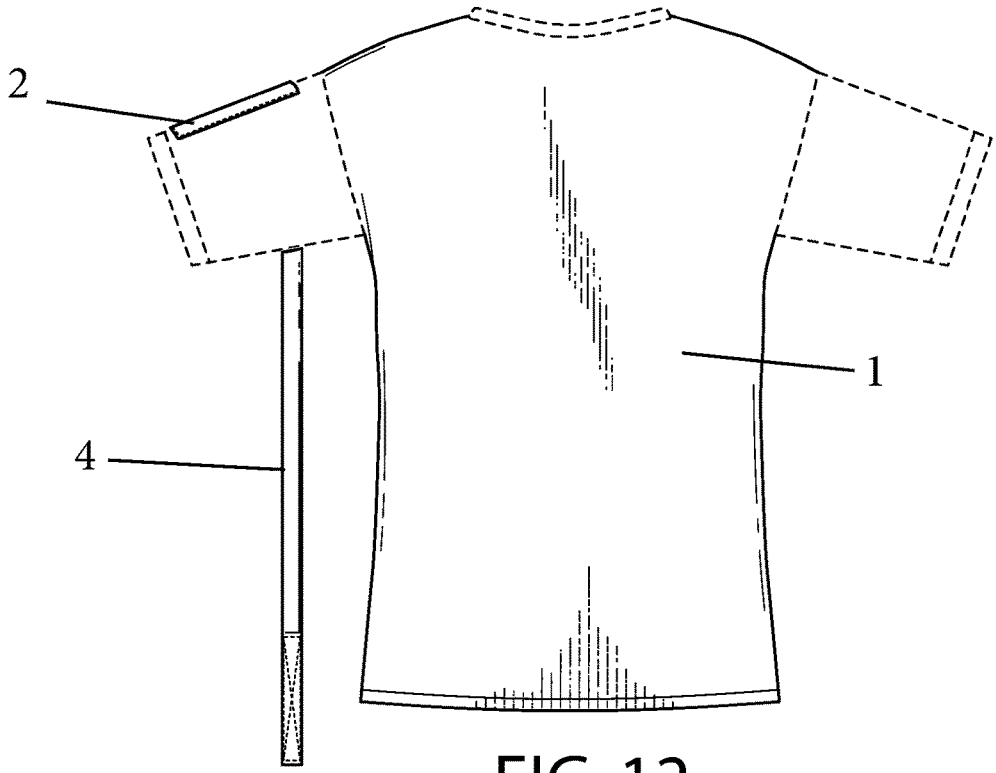
FIG. 12 is a back view of one embodiment of the athletic shirt.

FIG. 10 is a perspective view of one embodiment of the athletic shirt 1. FIG. 11 and FIG. 12 are front and back views of one embodiment of the athletic shirt 1. In one embodiment, the shirt may have a strap 4 affixed to the bottom portion of the sleeve of an athletic shirt 1, wherein a receiver 3 is not necessary.

Figure 13:
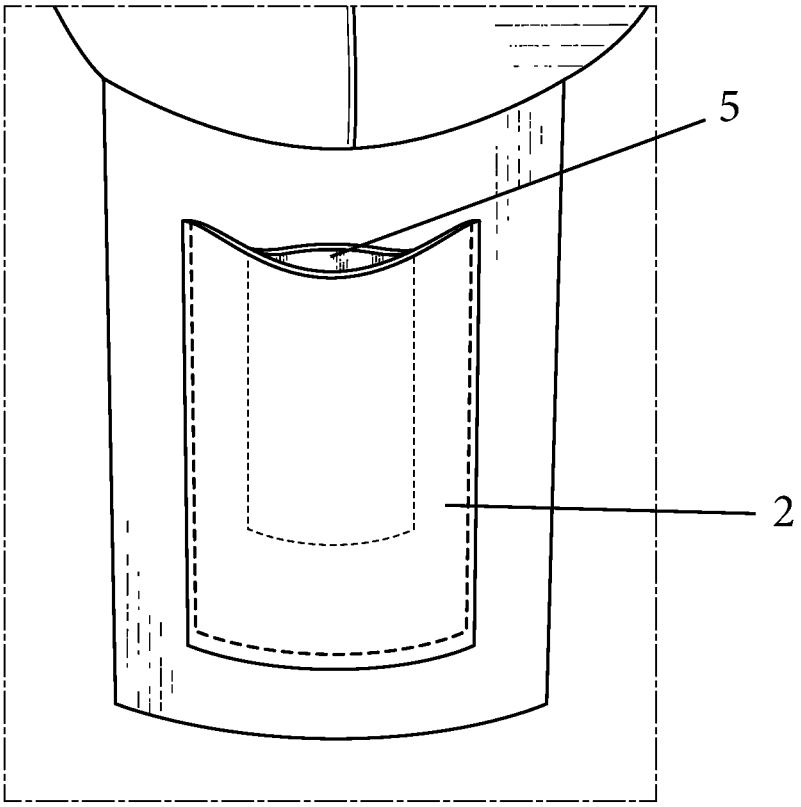
FIG. 13 is a zoomed-in view of one embodiment of a pocket of the athletic shirt.

FIG. 13 is a zoomed-in view of one embodiment of the pocket 2 of the athletic shirt 1. The pocket 2 may have an interior pocket 5 that is designed to hold smaller items, such as keys, cash, cards, or other personal items. This feature allows the shirt to hold items other than a user's mobile device while he or she exercises and these items, including the mobile device, can be securely strapped down via the strap 4.

In yet another embodiment, the athletic shirt 1 has a wire management system, wherein there are holes that receive a headphone wire and guide the wire towards an aperture near the collar so that an individual's headphone wires do not get tangled or flail while the individual is exercising.

The athletic shirt 1 may be composed of, or a blend of, cotton, polyester, nylon, lycra, cashmere, wool, and other antimicrobial or sweat wicking fabrics.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

I claim:

1. An athletic shirt comprising: two sleeves; a midriff with a hemline; at least one pocket on one of said sleeves; a receiver that has a hook with an upturned catch on a bottom side hemline of said one sleeve whereby the receiver is positioned on an opposite side of the one sleeve relative to the pocket; and a removable strap, wherein the strap features a loop that is hooked and caught by said upturned catch of connected to the receiver and wherein the strap is wrapped all the way around the sleeve and pocket to secure a mobile device deposited within the pocket.

2. The athletic shirt of claim 1, wherein the strap has a hook end and a loop pile fastener end.

3. The athletic shirt of claim 1, wherein the pocket has an interior pocket.

4. The athletic shirt of claim 1, wherein the pocket is configured to receive a mobile device.

5. The athletic shirt of claim 1, wherein the strap has a button and button-hole attachment.

6. The athletic shirt of claim 1, wherein the strap has a zipper attachment.

7. The athletic shirt of claim 1, wherein the shirt features at least one three-quarter sleeve.

8. The athletic shirt of claim 1, wherein the shirt features a crewneck collar.

9. The athletic shirt of claim 1, wherein the shirt features a v-neck collar.

10. The athletic shirt of claim 1, wherein the shirt features a button-up collar.

11. The athletic shirt of claim 1, wherein the shirt is composed of cotton.

12. The athletic shirt of claim 1, wherein the shirt is composed of polyester.

13. A method of securing a mobile device to an individual's person, comprising: obtaining an athletic shirt with at least one pocket on a shoulder portion of a sleeve, a midriff with a hemline, a receiver adjacent to an arm-pit portion of the sleeve so that the receiver is located on an opposite side of the sleeve relative to the pocket, the receiver having a hook and upturned catch, and a removable strap with a hook fastener and loop pile fasteners; putting the athletic shirt on the individual's person placing a mobile device into the pocket so that the mobile device is situated proximate to a shoulder of the individual's person; attaching the strap to the hook and upturned catch of the receiver; wrapping the strap all the way around arm of the individual's person, and the pocket with the mobile device so that the mobile device is strapped to the shoulder of the individual's person; and, securing the strap to itself by attaching hook and loop pile fastener ends together.

14. The method of claim 13, wherein the receiver is removed and the strap is attached directly to the athletic shirt.

15. The method of claim 13, wherein the pocket has an interior pocket.

* * * * *